US005377738A

United States Patent [19]

Cooper

[11] Patent Number: 5,377,738

[45] Date of Patent: Jan. 3, 1995

[54] SHUTTER ASSEMBLIES AND LATHS FOR THEM

[75] Inventor: George A. Cooper, Shropshire, England

[73] Assignee: Alsecure Limited, Telford, England

[21] Appl. No.: 32,508

[22] Filed: Mar. 17, 1993

[30] Foreign Application Priority Data

Mar. 18, 1992 [GB] United Kingdom ..... 9205834

[51] Int. Cl.[6] ..... E06B 9/08

[52] U.S. Cl. ..... 160/133; 160/264

[58] Field of Search ..... 160/133, 264, 32, 33, 160/270, 271, 272, 273.1, 236, 232, 235, 405; 49/50, 51, 56, 64, 92.1

[56] References Cited

U.S. PATENT DOCUMENTS 3,292,685 12/1966 Clark ..... 160/264 X
3,489,200 1/1970 Recchione ..... 160/133
4,432,591 2/1984 Rinkewich ..... 160/235 X
4,690,193 9/1987 Morrison et al. ..... 160/133

FOREIGN PATENT DOCUMENTS 0248837 12/1986 European Pat. Off. .
0354987 6/1989 European Pat. Off. .

*Primary Examiner*—David M. Purol
*Attorney, Agent, or Firm*—Christensen, O'Connor, Johnson & Kindness

[57] ABSTRACT

A shutter assembly has a plurality of laths which extend between a pair of vertically extending side channels disposed to either side of a doorway, window or the like. A number of the laths are strengthened and are hollow box sections through which a pair of wire cables extend. The wire cables are anchored to retention members which can move vertically in the side channels. The remaining laths have windlocks at their ends which are located in and are moveable in the side channels. The wire strengthened laths are alternately interlaced with the remaining laths. The wire cables give additional strength to the strengthened laths and are sufficiently strong to withstand a heavy blow to the shutter assembly in the vicinity of the strengthened laths, extending with the blow and thereby absorbing energy rather than breaking.

21 Claims, 5 Drawing Sheets

SHUTTER ASSEMBLIES AND LATHS FOR THEM

FIELD OF THE INVENTION

This invention relates to shutter assemblies, for example, for doors or windows. The invention also relates to laths which comprise component parts of shutter assemblies.

1. Background of the Invention

It is now common for shop doors to be closed at night by shutters comprising a plurality of laths or louvers joined together. These shutters can usually be lifted or rolled up during the day to open the doorway in order to allow access, for example, to a shop. A growing problem with shops is a crime which has been colloquially termed "ram-raiding" in which criminals drive a vehicle into a door or a shutter closing a doorway to force entry into premises. It is difficult to stop ram-raiding. At present, a structurally effective and aesthetically sound means of preventing ram raiding has not been found.

2. Description of the Prior Art

It is known from European Patent No. 0 248 837 to provide the laths of a roller shutter with a rigid flat steel strip, or rod, passing through a hollow center of the lath, the ends of the steel strip carrying guide pins which are received in and cooperate with guideways provided at the side of a doorway.

It is an aim of the invention to provide a new shutter suitable for preventing or hindering ram raiding.

SUMMARY OF THE INVENTION

According to a first aspect of the invention, I provide a lath for a shutter assembly comprising a lath body and an extensible member associated with the body, the extensible member having a location lug at each end adapted to be received in a channel at the side of an aperture, the arrangement of the lath being such that if the lath is hit by a vehicle the body and extensible member will extend, the extensible member absorbing energy as it extends so as to slow the vehicle.

Thus, the extensible member extends, rather than breaks, and in so doing absorbs energy and maintains the integrity of a barrier between one channel to one side of an aperture and another to the other side of the aperture.

EP 0 248 837 is not suitable to prevent ram raiding. It is too brittle and cannot absorb enough energy while maintaining its structural integrity. The shutter of EP 0 248 837 is designed to prevent entry by burglars using hand tools. This is a very different problem.

Preferably, the extensible member is also resilient. The extensible member is preferably a rope, such as a steel or wire rope. The extensible member is preferably received in a hollow cavity defined by the body of the lath.

According to a second aspect of the invention, I provide a shutter assembly comprising a plurality of laths extending between a pair of side channels disposed to either side of a doorway, window, or the like, at least one of the laths having a main body and an extensible member retained at each end to respective side channels by retention members associated with the extensible member, the extensible member being sufficiently strong to withstand a heavy blow to the shutter assembly in the vicinity of the extensible member, extending with the blow and thereby absorbing energy rather than breaking.

Preferably, the extensible member is resilient, and is most preferably a rope, such as a metal or wire cable. The rope is preferably sufficiently flexible as to bend through 90° within a length of 10 cm or so. The extensible member is preferably not stressed significantly in its normal state.

Preferably, there are a plurality of laths having extensible members and associated retention members. Preferably, at least one lath having an extensible member is interposed between two laths having no extensible member, and/or vice versa. Preferably, a set of laths having extensible members is alternatively interlaced with a set of laths having no such members.

A lath or laths, preferably one not having an extensible member, preferably has a guide lug at one, or both, of its ends received in a, or each respective, guide or side channel. The guide lug may be adapted to deform or break under the force of a vehicle hitting the closed shutter assembly, thus absorbing energy. The guide lug may be of plastic material.

The guide channels preferably define a sliding space for the retention members which may have guide faces adapted to co-operate with complementary faces on the guide channels to guide the members for longitudinal and/or transverse movement, at least when the shutter laths are deformed following a blow.

The retention members preferably have a first portion extending transversely to the extensible member and a second portion extending away from the first portion. The second portion may extend towards the aperture of the doorway or the like. There may be a pair of second portions, one or each of which is spaced from and faces a complementary recess in the guide channel.

The guide channels are, of course, fixed very firmly to the walls or other suitable structure adjacent the aperture capable of withstanding the impact generated by the vehicle.

According to a third aspect, the invention consists in a method of strengthening shutters comprising putting extensible members through or beside laths of a shutter and retaining the ends of the extensible members in side members adjacent to the ends of the laths.

BRIEF DESCRIPTION OF THE DRAWINGS

Embodiments of the invention will now be described by way of example only with reference to the accompanying drawings, of which.

Embodiments of the invention will now be described by way of example only with reference to the accompanying drawings.

DETAILED DESCRIPTION OF THE PREFERRED EMBODIMENT

Figure 1:
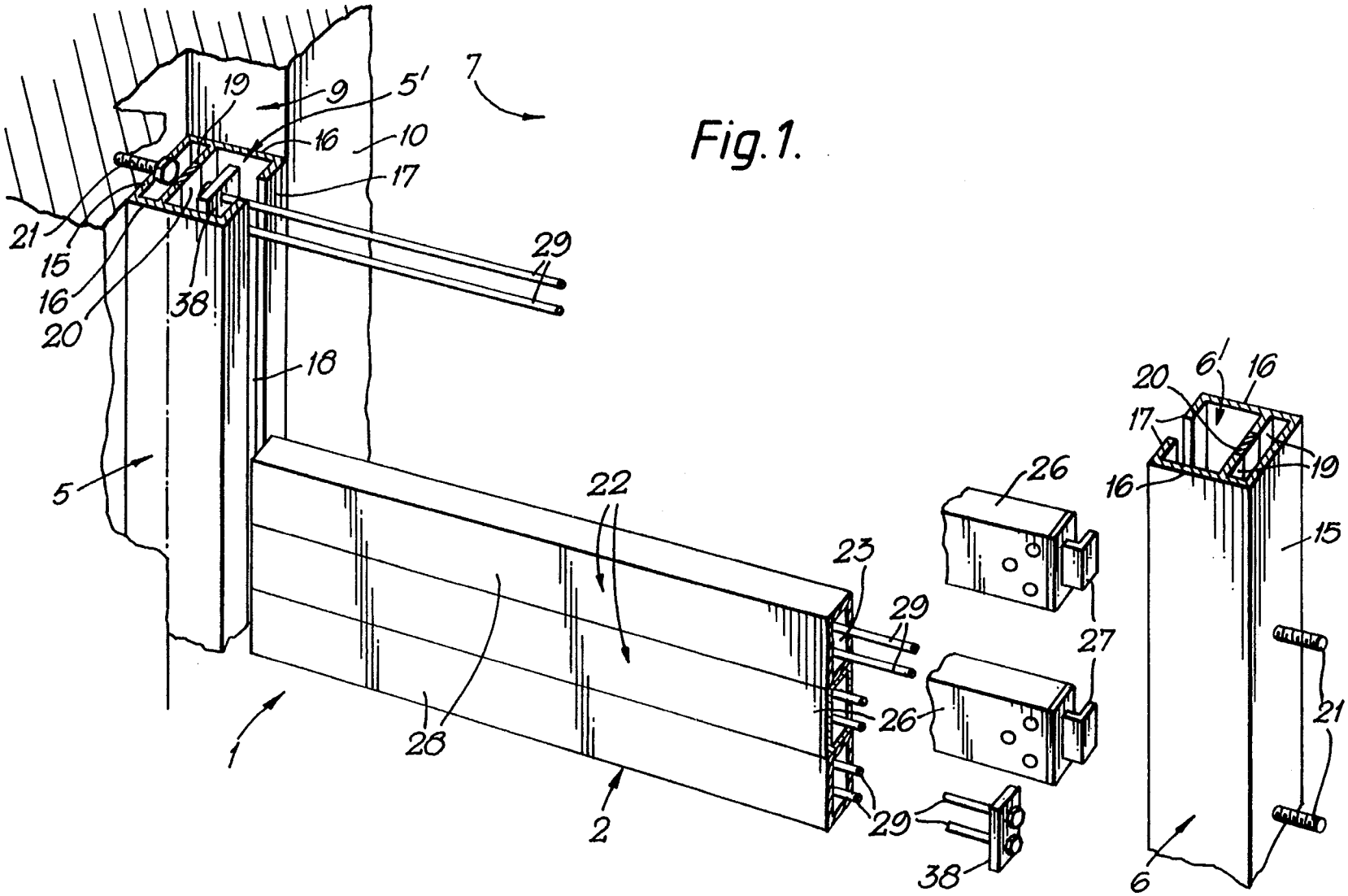
FIG. 1 shows a schematic cut-away perspective view of a part of a door shutter installation.
Figure 2A:
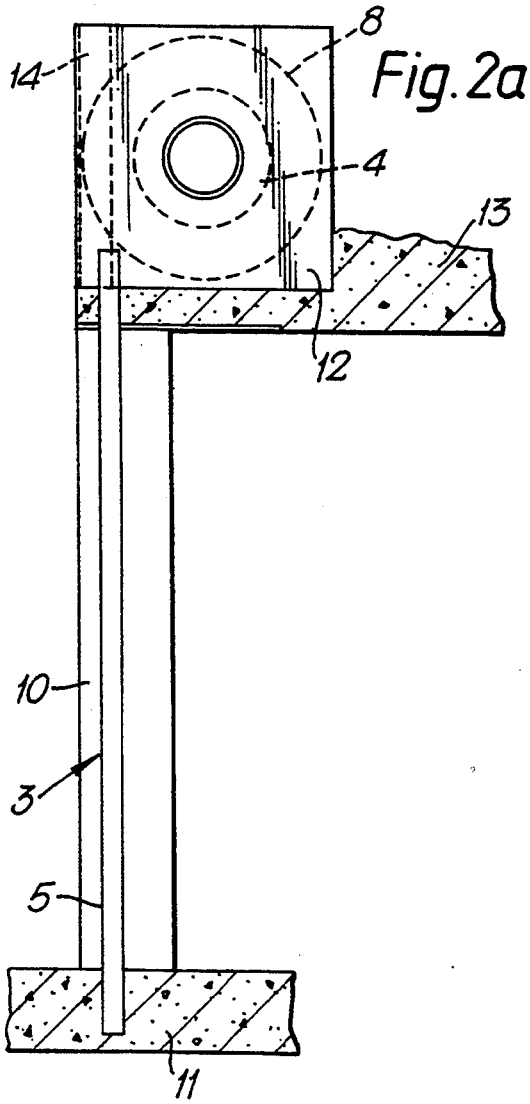
FIG. 2*a* shows a schematic side view of the installation of FIG. 1.
Figure 2B:
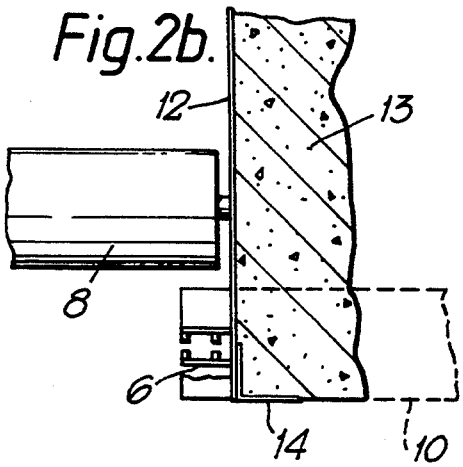
FIG. 2*b* shows a schematic view of a part of the installation from above.

FIGS. 1 and 2 show a roller shutter assembly 1 comprising a shutter 2, a mounting, or door, frame 3, and a motor 4.

The frame 3 comprises two opposed aluminum side channels 5 and 6, one to either side of a doorway 7 connected at their upper ends by a shutter retracting and rolling mechanism 8 having the motor 4 which moves the shutter up and down. The side channels 5 and 6 are recessed into appropriate receiving recesses 9 in walls 10 surrounding the doorway 7. The base of each channel 5 and 6 is set into a concrete floor 11. The shutter retracting and rolling mechanism 8 has anchor plates 12 which extend in a concrete ceiling 13 of the room which the shutter assembly closes. The anchor plates 12 have angle sections 14 to key them to the concrete ceiling against forces developed in a ram raid.

Each side channel 5 and 6 comprises a back wall 15, two side walls 16, and a pair of oppositely directed retention flanges 17 provided at the front edge of the side walls 16. The flanges 17 are spaced from each other and define a gap 18. The side walls 16 also have a second pair of oppositely directed partition flanges 19 at an intermediate point in their transverse extent. The partition flanges are spaced from each other and define a longitudinal gap which is filled by a removable plastics insert strip 20. Alternatively, the strip 20 may be omitted. When the insert strip 20 is in place, the flanges 19 and the strip 20 effectively form a continuous smooth wall. The back wall 15 has an array of mounting holes through which fixing means, such as bolts 21, extend to hold the channels to the walls 10. The side walls 16, retention flanges 17, partition flanges 19, and strip 20 define a vertically extending guideway 5′ or 6′.

The shutter 2 comprises individual interlinked laths, or slats, 22. Each lath has a hollow body 23 of extruded aluminum having a male hook formation 24 at its upper edge and a female socket formation 25 at its lower edge (best seen in FIG. 3*b* and FIG. 5). The male and female formations of adjacent laths are interlinked and allow a degree of pivoting about their junction. The shutter 2 is made of two kinds of laths, a first set of laths 26 having plastics material windlocks 27 at each end, and a second set of laths 28 having reinforced cables 29 passing through them. The two sets of laths are alternatively interlaced so that a lath of the first kind is interposed between adjacent laths of the second kind, and vice versa.

Figure 3A:
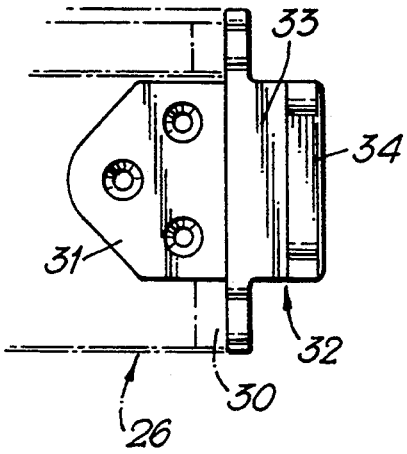
FIGS. 3*a* and 3*b* show details of a plastics guide lug provided at the end of a lath of the shutter of the installation of FIG. 1.
Figure 3B:
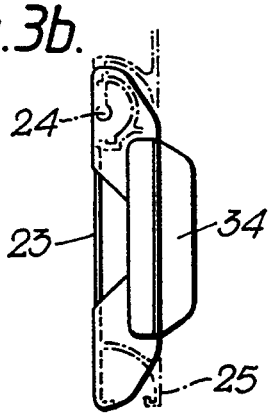

FIGS. 3*a* and 3*b* illustrate a lath 26. The windlock 27 at each end of the lath has a plug 30 inserted into the hollow end of the lath, a fixing plate 31 riveted to the lath, and a guide lug 32 received in use in the guideway 5′ or 6′ of whichever of the channels 5 or 6 it is retained in. The lugs 32 have a projecting portion 33 which extends through the gap 18, and a guide and retention portion 34 which locates behind a retention flange 17 and serves to guide the lath for vertical sliding movement.

Figure 4:
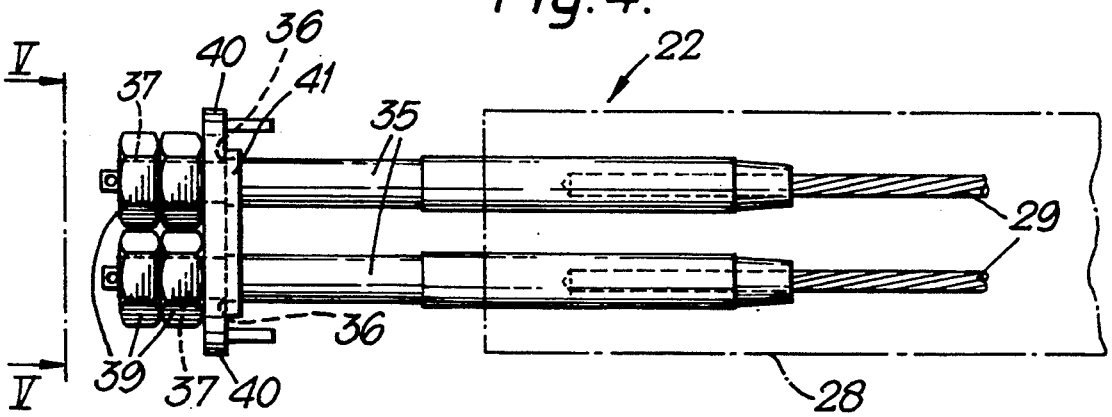
FIG. 4 shows detail of a lath of the installation of FIG. 1 having the lath body roughly represented schematically in chain dotted lines.
Figure 5:
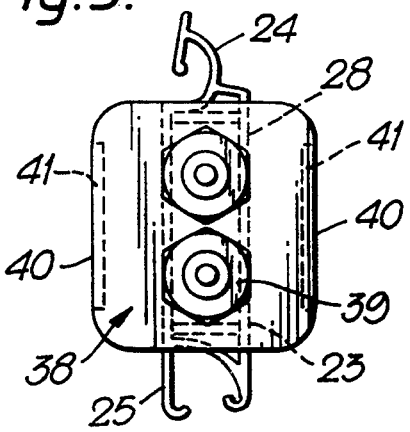
FIG. 5 shows an end view along line V—V of FIG. 4 in which the lath body is represented fully.
Figure 6:
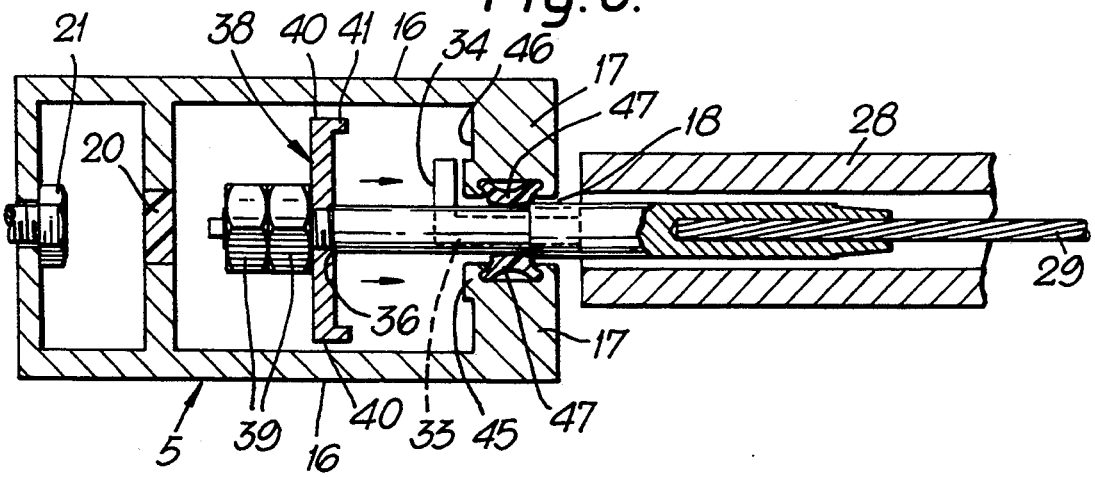
FIG. 6 is a cross-section of the guide channel and associated cable used in the installation of FIG. 1.

FIGS. 4 and 5 show a lath 28 of the other kind. A pair of the wire ropes 29, in this case a 7×19 rope (seven twisted strands each of nineteen wires) of about 6 mm in diameter, each with a breaking load of about 2000 kilograms. Such a rope can be bent by hand through 90° over a length of about 5 to 10 cm of the rope—it is quite flexible. Such a rope is also stretchable to a significant degree. The ends of the ropes 29 are swaged or otherwise connected to shafts 35 having abutment shoulders 36 and projecting screw threads 37. At each end of the lath 28 a metal retention formation, or plate, 38 is held clamped against the shoulders 36 by nuts 39. The retention formation 38 has a pair of vertical edges 40, each of which carries a projecting flange 41 extending towards the lath 28. The shafts 35 extend in use through the gap 18 and the retention formations 38 are held and retained in the guideways 5′ and 6′, without touching the guideways. The relative positions in the guideway of the retention formations 38 and the windlocks 27 are shown in FIG. 6.

The removable and replaceable strips are snapped into place after the channels 5 and 6 have been bolted to the walls. Alternatively, they could be omitted if there is no danger of fouling on the bolts which hold the channel in place. A force-spreading plate may be provided between a channel-mounting bolt and tile channel wall 15.

When the shutter is in normal use, the windlocks 27 contact the channels 5 and 6 and are guided for vertical sliding movement. The retention formations 38 do not touch anything and are simply carried from their laths 28. The motor lifts the shutter up and down. The cables 29 are not tensioned to any significant extent—they are just taut enough to eliminate slack.

When the shutter 2 is hit by a vehicle, such as a car, during a ram-raid, the hollow bodies of the two kinds of laths buckle under impact. The plastics windlocks may be strong enough to stop the car, but if the car is travelling fast enough, they will break off or be so deformed that they pull out of the channels 5 and 6. As the laths buckle more and more, the cable 29 will draw the retention formations 38 towards the retention flanges 17. When the retention formations 38 hit the flanges 17, further forward movement of the car results in the cables 29 stretching and absorbing energy. The retention formations 38 anchor the cables to the channels 5 and 6 as they stretch. The interlinked laths have sufficient inherent strength, and the joints between adjacent laths are strong enough, to distribute the impact load through the connecting joints to other laths containing other cables. Thus, the impact energy of a vehicle is absorbed by several cables, not just those of a particular lath. The impact energy of the car is absorbed by the stretching of the cables, and the car is slowed and should eventually be stopped with the doorway still being blocked by the deformed but structurally substantially whole shutter. In some extreme cases the car may break the shutter.

It will be appreciated that the bending of the bodies of the laths, the deformation and/or breaking of the windlocks, and the bending and stretching of the cables all absorb energy and serve to slow the car progressively, rather than trying to present a rigid barrier which needs to be very strong or it will break. By absorbing the energy progressively, one can provide a shutter which is effective against ram raiding.

The edges 40 and flanges 41 of the formations 38 ensure that the formation does not twist too much as it is drawn towards the retention flanges 17.

It will also be noted that the flanges 17 of FIG. 6 are slightly different from those shown in FIG. 1 in that they have rearwardly projecting lips 45. The flanges 41 of the retention formation 38 hook into the recess (referenced 46) between the lips 45 and the side walls 16. FIG. 6 also shows the provision of plastics slide strips 47 to reduce friction and noise during opening and closing of the shutter and to seal against the ingress of dirt.

It will also be appreciated that strip 20 may enable a smooth continuous wall surface to be presented near the nuts 39 which helps to avoid them fouling, should the laths experience side-to-side forces during sliding of the shutter.

Figure 7:
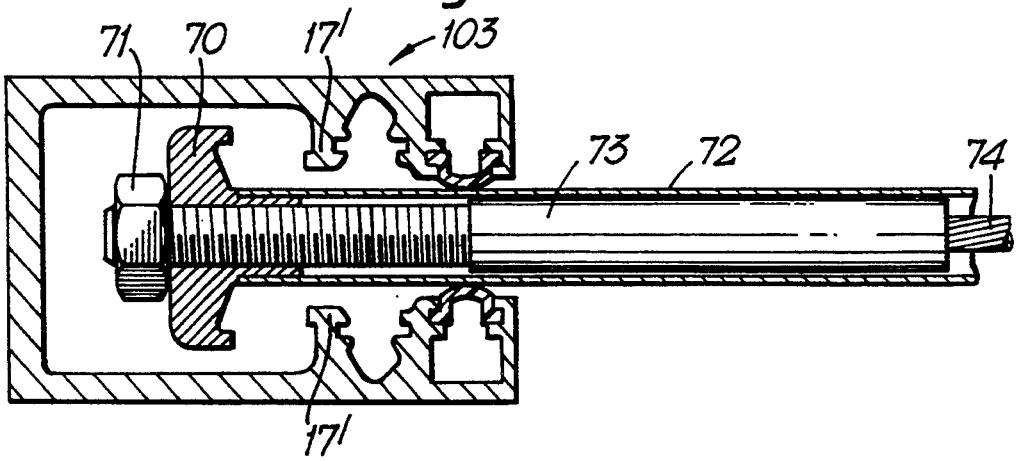
FIGS. 7 and 8 show details of an alternative retention member, and guide channel.
Figure 8:
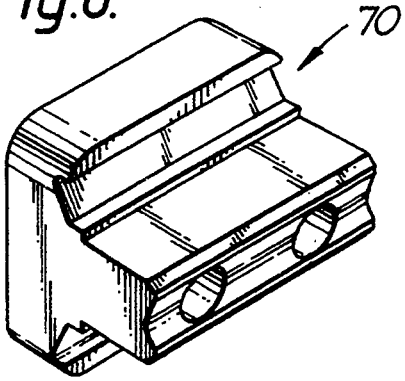

FIGS. 7 and 8 illustrate an alternative retention member 70 held by a pair of bolts 71 against a hollow lath body 72. The bolts 71 are screwed onto screw-threaded ends of a pair of couplings 73 swayed to respective ones of a pair of cables 74 housed in the hollow cavity of the lath body 72. The member 70 is made of extruded aluminum. The retention member 70 is received in a space defined by a guide, or side, channel 103.

The co-operation between the member 70 and the channel 75 is similar to that shown in FIG. 6.

Figure 9:
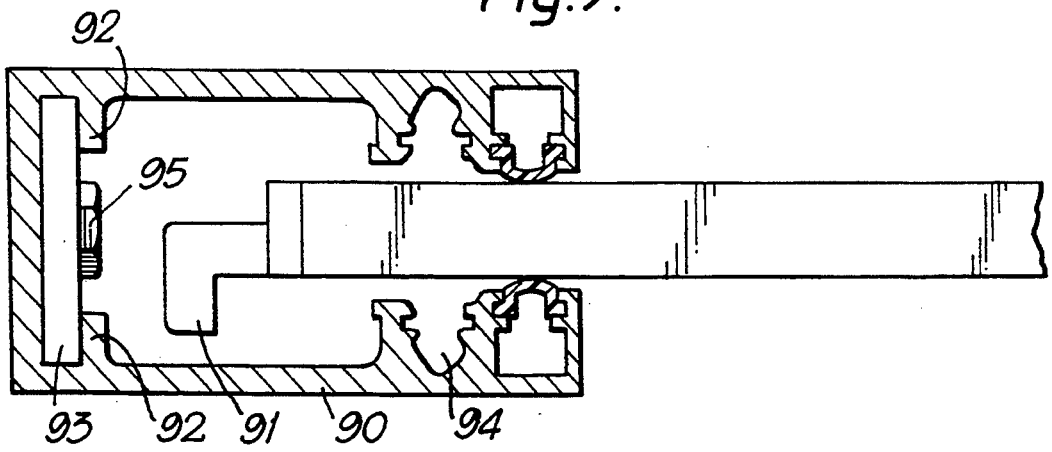
FIG. 9 shows detail of an alternative guide channel and windlock arrangement.

FIG. 9 shows an arrangement of a side channel 90 and a windlock 91 in which the channel 90 has a pair of partition flanges 92, but no insert strip similar to strip 20 is provided. The arrangement of the windlock 91 is such that it cannot foul on any mounting bolts 95 provided to mount the channel 90 to a wall. The head of the windlock engages the flanges 92 if it is pushed towards them, and this restrains inward movement of the windlock which might otherwise cause fouling.

FIG. 9 also shows the provision of a force spreading bar 93 interposed between the channel 90 and a plurality of mounting bolts. The channel 90 defines a pair of recesses 94 which may receive dust brushes, either in addition to the seal strips shown or instead of them.

Figure 10:
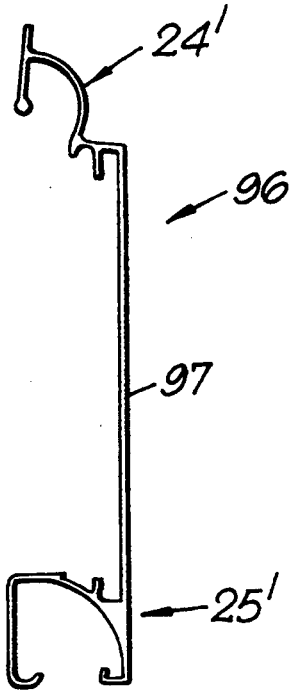
FIG. 10 shows a cross section of an alternative lath.

An alternative lath 96 is shown in FIG. 10. Unlike the laths 26 and 28, this lath 96 is not a hollow box section. The lath is in the form of a sheet 97 which is provided with a male hook formation 24' and a female socket formation 25' at its upper and lower portions. The lath 96 may also be provided with windlocks at each end of its ends in order to provide additional energy absorbing components in the event of an impact to the shutter.

Figure 11:
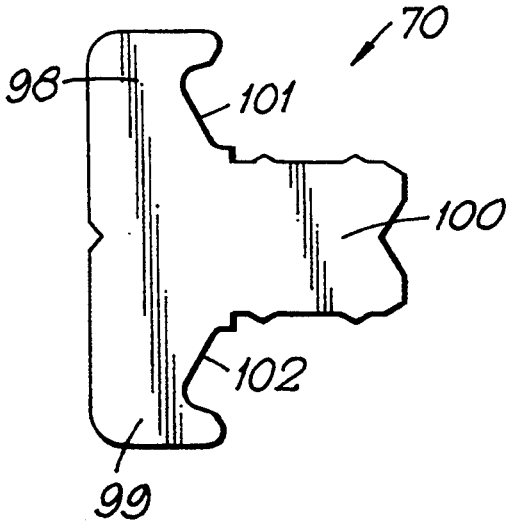
FIG. 11 shows a side view of the alternative retention member of FIGS. 7 and 8.

FIG. 11 shows the retention member 70 in greater detail. The member is basically in the form of a T-shape with two arms 98 and 99 branching off from a body portion 100. Inner surfaces of the arms are linked to the body portion 100 and define sloping surfaces 101,102. FIG. 7 shows this retention member located in a guide channel 103. If the shutter is hit by a vehicle and the laths buckle, the retention member 70 is by pulled in a horizontal direction and the inner surfaces 101,102 engage with retention flanges 17' thereby providing resistance against the movement of the retention member 70 out of the guide channel 103, and usually retaining it within the channel.

The body portion of the retention member is provided with ridges 104 and 105 which each encircle the body portion 100. The ridges anchor the retention member securely into a hollow lath body 72.

I claim:

1. A shutter assembly comprises a pair of side channels, a plurality of laths extending between said side channels, at least one of said laths having a main body and a multi-stranded member, each end of said multi-stranded member being retained to a respective said side channel by retention means associated with said multi-stranded member, wherein said multi-stranded member is adapted to extend as a consequence of a heavy blow being applied to the shutter assembly.

2. A shutter assembly according to claim 1 in which said laths having a multi-stranded member comprise reinforced laths.

3. A shutter assembly according to claim 1 wherein there is a plurality of laths having multi-stranded members and associated retention means.

4. A shutter assembly according to claim 1 wherein at least one reinforced lath having a multi-stranded member, is interposed between two unreinforced laths having no multi-stranded member.

5. A shutter assembly according to claim 1 wherein at least one unreinforced lath is interposed between two said reinforced laths each of which has a said multi-stranded member.

6. A shutter assembly according to claim 2 wherein a set of said reinforced laths having multi-stranded members is alternatively interlaced with a set of unreinforced laths.

7. A shutter assembly according to claim 1 in which an unreinforced lath has a guide lug at one of its ends.

8. A shutter assembly according to claim 7 wherein said guide lug is received in a guide channel located in one of said side channels.

9. A shutter assembly according to claim 7 wherein said guide lug is adapted to deform or break under the force of a vehicle hitting said shutter assembly when closed, thus absorbing energy.

10. A shutter assembly according to claim 7 wherein said guide lug is of plastics material.

11. A shutter assembly according to claim 1 wherein said multi-stranded member is substantially unstressed in its normal state.

12. A shutter assembly according to claim 8 wherein said guide channel defines a sliding space for said retention means which has guide faces adapted to co-operate with complementary faces on said guide channel to guide the said retention means for longitudinal movement of said guide channel.

13. A shutter assembly according to claim 1 wherein said retention means has a first portion extending transversely to said multi-stranded member and a second portion extending away from said first portion.

14. A shutter assembly comprises a pair of side channels, a plurality of laths extending between said side channels, at least one of said laths having a main body and a longitudinally extensible member, each end of said extensible member being retained to a respective said side channel by retention means associated with said extensible member, wherein said extensible member is adapted to extend progressively as a consequence of a heavy blow being applied to the shutter assembly.

15. A shutter assembly according to claim 14 wherein said extensible flexible member comprises a cable.

16. A lath for a shutter assembly comprises a lath body, an extensible member associated with said body, a first lug provided at a first end of said member, a second lug provided at a second end of said member, and wherein at least one of said lugs is adapted to be received in a channel provided adjacent an aperture across which the lath extends in use, and wherein said extensible member is adapted to extend if said lath is deformed by an impact, said extensible member absorbing energy as it extends.

17. A lath according to claim 16 wherein said extensible member is received in a hollow cavity defined by said body of said lath.

18. A lath according to claim 16 wherein said extensible member is a metal or wire cable.

19. A lath according to claim 16 wherein said extensible member is a rope.

20. A method of strengthening shutters comprising putting extensible members through or beside laths of a shutter and retaining the ends of said extensible members in side members adjacent to the end of the laths.

21. A method according to claim 20 wherein cables comprise said extensible member.

* * * * *

UNITED STATES PATENT AND TRADEMARK OFFICE

CERTIFICATE OF CORRECTION

PATENT NO. : 5,377,738

DATED : January 3, 1995

INVENTOR(S) : G. A. Cooper

It is certified that error appears in the above-indentified patent and that said Letters Patent is hereby corrected as shown below:

On the title page, item [73], line 1, "Telford," should read --Shropshire--; and item [30], line 1, "9205834" should read --9205834.6--.

Column 1, line 9, "1. Background of the Invention" should read --Background of the Invention--.

Column 1, line 9, "2. Description of the Prior Art" should read --Description of the Prior Art--.

Column 5, line 53, "101,102." should read --101, 102.--.

Column 5, line 57, "101,102" should read --101, 102--.

Signed and Sealed this

Thirtieth Day of May, 1995

*Attest:*

*Attesting Officer*

BRUCE LEHMAN

*Commissioner of Patents and Trademarks*